US007810807B2

(12) United States Patent
Liebheit

(10) Patent No.: US 7,810,807 B2
(45) Date of Patent: Oct. 12, 2010

(54) DEVICE FOR CENTERING AN OVERLAPPING SHEET FLOW

(75) Inventor: Stefan Liebheit, Wohlen (CH)

(73) Assignee: Mueller Martini Holding AG, Hergiswil (CH)

( * ) Notice: Subject to any disclaimer, the term of this patent is extended or adjusted under 35 U.S.C. 154(b) by 184 days.

(21) Appl. No.: 10/912,087

(22) Filed: Aug. 6, 2004

(65) Prior Publication Data

US 2005/0006838 A1 Jan. 13, 2005

(30) Foreign Application Priority Data

Aug. 7, 2003 (EP) ..... 03405580

(51) Int. Cl.
*B65H 9/00* (2006.01)

(52) U.S. Cl. ..... 271/238; 271/240; 271/248

(58) Field of Classification Search ..... 271/226, 271/248, 234, 237, 238, 240, 69, 149, 151, 271/264, 275, 286, 314; 198/416, 780–791
See application file for complete search history.

(56) References Cited

U.S. PATENT DOCUMENTS

| | | | | |
|---|---|---|---|---|
| 2,853,298 | A * | 9/1958 | Faeber | 271/210 |
| 3,507,379 | A * | 4/1970 | Johnston | 198/787 |
| 4,015,843 | A * | 4/1977 | Tennant | 271/240 |
| 4,232,860 | A | 11/1980 | Brown | |
| 4,381,108 | A * | 4/1983 | Newsome | 271/198 |
| 4,767,116 | A * | 8/1988 | Eberle | 271/238 |
| 4,958,717 | A * | 9/1990 | Everhart | 198/416 |
| 4,973,037 | A * | 11/1990 | Holbrook | 271/2 |
| 5,203,246 | A * | 4/1993 | Smitterberg et al. | 83/420 |
| 5,379,879 | A * | 1/1995 | Mantovani et al. | 198/382 |
| 5,954,324 | A * | 9/1999 | Rehberg et al. | 271/2 |
| 6,120,239 | A * | 9/2000 | Roskam | 414/791.2 |
| 6,296,248 | B1 * | 10/2001 | Tanaka | 271/240 |
| 6,461,101 | B1 * | 10/2002 | Roskam | 414/790.8 |
| 6,945,530 | B2 * | 9/2005 | Cinotti et al. | 271/240 |

FOREIGN PATENT DOCUMENTS

| | | | |
|---|---|---|---|
| DE | 3113399 | A1 | 10/1982 |
| DE | 3221601 | A1 | 3/1983 |
| EP | 0 223 941 | A1 | 6/1987 |
| EP | 0 376 519 | A2 | 7/1990 |

* cited by examiner

*Primary Examiner*—Richard W Ridley
*Assistant Examiner*—Michael C McCullough
(74) *Attorney, Agent, or Firm*—Venable LLP; Robert Kinberg; Leigh D. Thelen

(57) ABSTRACT

The device comprises a driven conveyor with a transport element for the horizontal guidance of an overlapped flow of product. Driven alignment units for aligning the sides of the overlapped flow are positioned on a support. A first alignment unit is arranged on the left side of the driven conveyor as seen in transporting direction, and a second alignment unit is arranged on the right side of the conveyor as seen in transporting direction. At least one device is provided for loosening up the overlapped flow from below, thus reducing the friction between adjacent individual products of the overlapped flow. As a result, the operation of centering the overlapped flow in an intake region and a steady-flow region is aided considerably. The device for loosening up the overlapped flow can be realized particularly cost-effectively through raised regions on the transport rollers.

16 Claims, 2 Drawing Sheets

DEVICE FOR CENTERING AN OVERLAPPING SHEET FLOW

CROSS-REFERENCE TO RELATED APPLICATION

This application claims the priority of European Patent Application No. 03405580.6, filed on Aug. 7, 2003, the subject matter of which is incorporated herein by reference.

BACKGROUND OF THE INVENTION

The invention relates to a device for centering an overlapped flow of printed products, said device comprising a driven conveyor provided with at least one transport element for moving the overlapped flow in horizontal direction, and comprising in one section of the conveyor a support with thereon arranged driven means for aligning the overlapped flow on the side, wherein these means comprise a first alignment unit, arranged on the left side as seen in transporting direction, and a second alignment unit, arranged on the right side as seen in transporting direction.

Devices of the aforementioned type are used in particular in the region of further print processing, for example for feeding printed products to rotary cutters, bundle delivery machines, stackers and the like. The individual products in the overlapped flow can also be non-printed or individual folded or non-folded sheets.

A device of the aforementioned type, used for centering an overlapping flow of newspapers, is known from reference U.S. Pat. No. 4,015,843. The device is provided with endless belts fitted around rollers on the side, which are arranged on a frame. These belts form a funnel-shaped intake region in which randomly arranged printed products in the overlapping flow are gripped and centered. However, this device is not suitable for higher speeds.

Reference DE 31 13 399 A discloses a device provided with conveying belts for the horizontal guidance, which are arranged such that they can be displaced at least in part crosswise to the transporting direction and can be adjusted by means of an adjustment device together with an adjacent external transporting element. Side-mounted stop bars ensure the vertical guidance, wherein these bars can also be arranged in a funnel-type arrangement.

The device disclosed in reference DE 32 21 601 A for centering an overlapping flow is provided with movable walls on the side, which act upon this flow during the transport. The side walls are arranged so as to converge in conveying direction of the overlapping flow, while endless belts ensure the horizontal guidance.

A device where side-mounted belts are used to center the overlapping flow is disclosed in Reference EP 0 223 941 A. These belts are positioned so as to be adjustable relative to each other, such that they can be adjusted to the width of the respective overlapping flow.

SUMMARY OF THE INVENTION

It is the object of the present invention to create a device of the aforementioned type, which can be produced more cost-effectively and can be used to center an overlapped flow of products, even at comparably high speeds. The centering should be reliable, even at a comparably high throughput for the products.

With a device according to the invention, this object is solved by providing means for loosening the overlapped flow from below.

It has turned out that loosening up the flow is a surprisingly effective way to support the centering operation, even at higher speeds, e.g. with a through speed of 1 m/s or more.

In particular, the overlapped flow is loosened through vibrating it from below, which can be achieved with structurally very simple and robust parts.

According to one modification of the invention, the flow is loosened with the aid of raised areas on the transport element.

In particular, these raised areas are arranged on the transport rollers which extend transverse to the transporting direction.

The overlapped flow is preferably loosened up in the intake region or just prior to the intake region.

According to a different modification of the invention, a particularly effective centering at high speeds is possible if the two alignment units in conveying direction form first an intake region and subsequently a steady-flow region.

The intake region of another modification of the invention is provided with driven rollers across which at least one belt is guided, wherein this intake region is preferably funnel shaped.

According to yet another modification of the invention, the steady-flow region comprises several vertical rollers which are exposed, at least in some sections, so that the overlapped flow in this steady-flow region is guided directly on these vertical rollers. The transporting element has an empty space between rollers, meaning no belt or metal guide are provided. The rollers have a round design and no eccentrics. Thus, the overlapped flow is not vibrated on the side in the steady-flow region and the flow is continuously aligned on the side. Experiments have shown, however, that side-mounted belts in the steady-flow region would prevent individual product edges that may have been bent upward from lying down flat again. If the individual products in this steady-flow region are guided on vertical rollers, such upward tilted product corners can lay down flat again. It is preferable if no further side vibrating movement occurs even in the intake region, but only a loosening up from below.

BRIEF DESCRIPTION OF THE DRAWINGS

One exemplary embodiment of the invention is explained in further detail in the following with the aid of the drawing, which shows in.

DETAILED DESCRIPTION OF THE INVENTION

Figure 2:
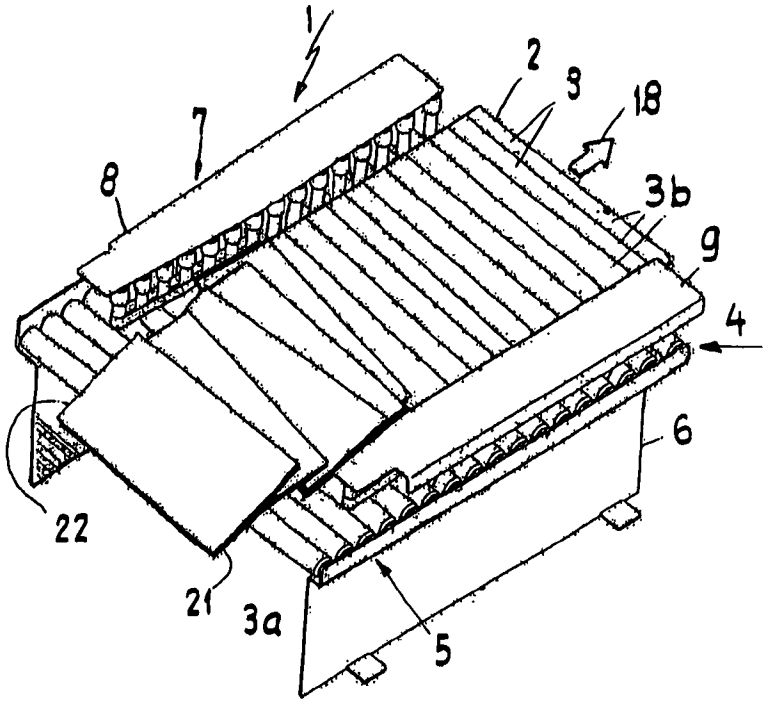
FIG. 2A device according to FIG. 1, as well as schematically the alignment of an overlapped flow.
Figure 1:
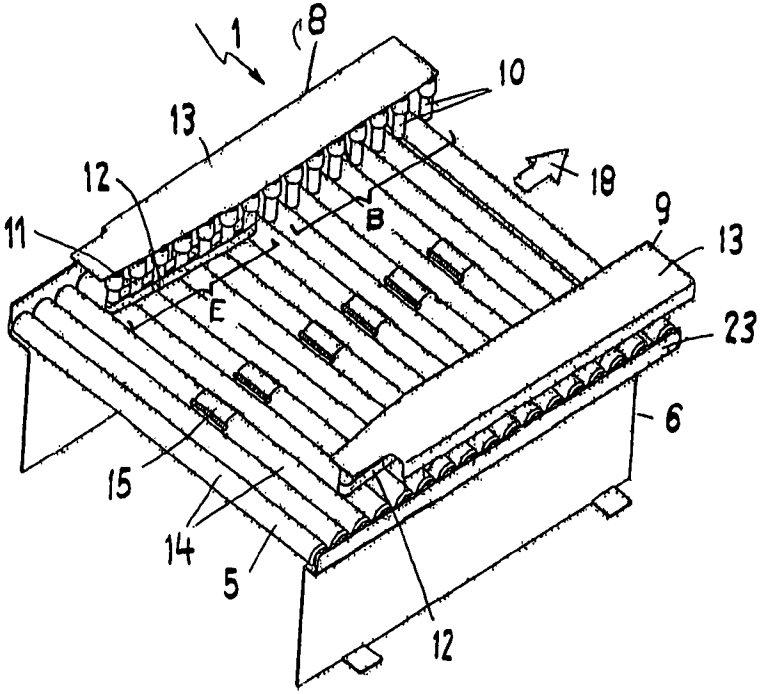
FIG. 1A schematic three-dimensional view of a device according to the invention.
Figure 3:
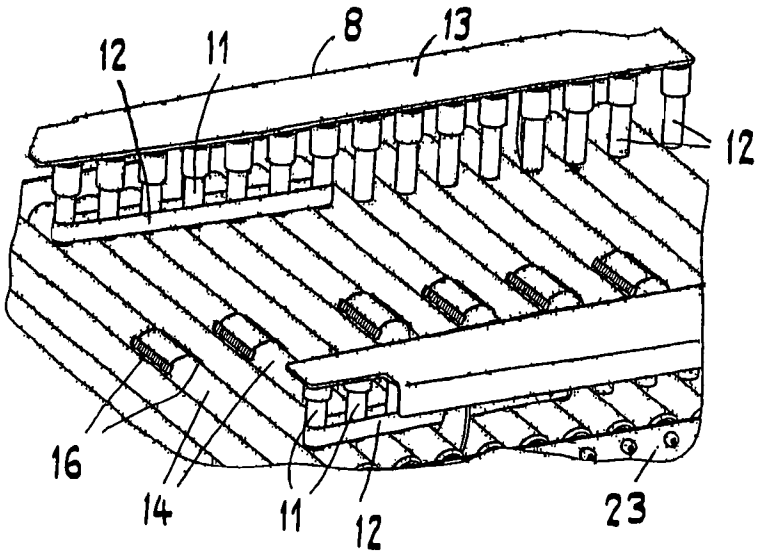
FIG. 3A partial view of the device according to FIG. 1.
Figure 4:
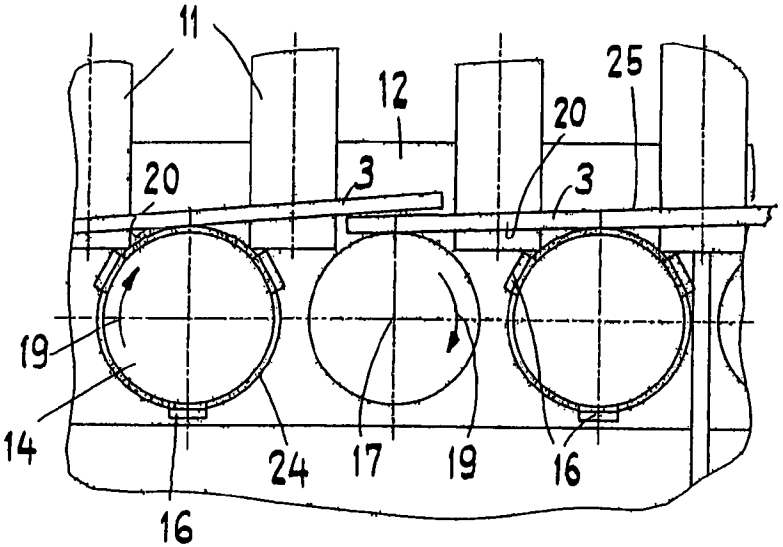
FIG. 4A different partial view of the device according to FIG. 1.

The device 1 shown in FIG. 1 is used for conveying and centering the overlapped flow of products 2, shown in FIG. 2, in the direction of arrow 18. A conveyor 4 is provided for the guidance in horizontal direction, which conveyor comprises a transport element 5 with several driven transport rollers 14. These transport rollers 14 are positioned rotating in side-mounted rails 23 and are driven by a drive element, not shown herein, such that all transport rollers 14 turn in the same direction and with the same speed around their axis 17 (FIG. 4). As shown in FIG. 4, the rollers 14 are positioned respectively at a distance to each other, thus leaving an intermediate space between adjacent rollers. The rollers 14 are driven in the direction of arrow 19, as shown in FIG. 4. FIGS. 1 and 2 only show a section of the conveyor 4 which feeds the overlapped flow 2 to the device 1 and also conveys it away from this device.

The transport element 5 is mounted on a support 6, arranged in one section of the conveyor 4.

Two alignment units 8 and 9 are furthermore positioned on the support 6. As seen in transporting direction, the alignment unit 8 is located on the left side and the alignment unit 9 on the right side of the conveyor 4. The two alignment units 8 and 9 are respectively provided with one bearing plate 13, having several vertical rollers 10 and 11 positioned on the underside. These rollers 10 and 11 are respectively arranged at a distance to each other and are driven, wherein this drive can be the same drive that also operates the transport element 5 and/or the transport rollers 14. The two alignment units 8 and 9 form the means 7 for centering the overlapped flow 2 and have mirror-inverted designs.

The transport rollers 11 are arranged conically converging in an intake region E, as seen in the direction of arrow 18, thus providing the intake region E with a funnel-type design. The two alignment units 8 and 9 are respectively provided with an endless belt 12 that is guided around rollers 11. As can be seen, the belts 12 are arranged in a lower region of the vertical rollers 11 and thus directly above the transport rollers 14. The belts 12 are driven via the rollers 11 and cooperate with the overlapped flow 2.

The vertical rollers in the steady-flow region B are exposed, meaning without belt or metal guide. The space between the vertical rollers 10 of the left alignment unit 8 and the rollers 10 of the right alignment unit 9 is thus empty. In addition, the region is no longer funnel-shaped and/or conical since the spacing between opposite-arranged vertical rollers 10 is essentially uniform. A slightly conical course is conceivable, however.

FIG. 2 schematically shows the centering of the overlapped flow 2 with the aid of the device 1. The individual products 3*a*, shown in FIG. 2, of the overlapped flow 2 are essentially out of order. The displacement to the side of the individual products 3*a* in this case can be up to approximately +/−20 mm. At the discharge location for the device, individual products 3*b* of the overlapped flow 2 are for the most part centered, meaning the respective bottom edges 21 and the top edges 22 of the following individual products 3 extend parallel to each other. The centering and/or alignment of the individual products 3*a* occurs in the intake region E by means of the driven side-mounted belts 12. This centering and/or side alignment is aided a great deal by a loosening up of the overlapped flow 2 in the intake region E.

Means 15 that are arranged on at least one of the transport rollers 14 are used for loosening up the overlapped flow 2, in particular in the intake area E. According to FIG. 4, these means 15 have raised areas 16 that are arranged in the center, as can be seen, and extend in longitudinal direction of the rollers 14. FIG. 1 shows that not all transport rollers 14 are provided with such means 15. Thus, rollers 14 without such means 15 can also be arranged between the rollers 14 with respectively one means 15, wlhich is also shown in FIG. 4. In principle, an arrangement is also conceivable for which all rollers 14 are provided with such means 15. Also conceivable is an embodiment where the means 15 are not arranged on the transport rollers 14, but on other rollers which are not used for transporting or the like.

The means 15 are fastened to the rollers 14, so as to rotate along, wherein the fastening can be with the aid of a band 24 as indicated in FIG. 4. The raised areas 16 in this case are ridges that extend in the longitudinal direction of the rollers 14. However, other types of raised areas, e.g. cams, teeth and the like are conceivable as well. FIG. 4 shows respectively three raised areas 16 that are arranged on one roller 14, wherein the spacing between the raised areas 16 of a roller is uniform. Also conceivable is an embodiment with fewer or more than three such raised areas 16. The raised areas 16 on a transport roller 14 can take different forms. In addition, the external engagement surfaces of the raised areas 16, for example, can be ribbed or roughened up. The height H of raised areas 16, shown in FIG. 4, depends on the overlapped flow 2 to be centered and/or the individual products 3. The height H may reach several millimeters, for example from 1 to 5 mm. According to FIG. 4, these raised areas 16 strike the center of the underside 20 of the individual products 3, thus loosening up the overlapped flow 2 vertically from below with the aid of a vibrating movement. As a result of this vibrating movement and/or loosening up, the friction between the underside 20 and a top side 25 of overlapping individual products 3 is reduced. The loosened-up printed products 3 thus can be displaced easier and with less force crosswise to the transporting direction. In particular in the intake region E, a reliable centering and/or alignment is thus possible even at higher speeds.

Since the means 15 are arranged in the center of the transport rollers 14, as can be seen, the overlapped flow 2 is loosened along a center line. The vibrating movement propagates outward on both sides from this center line and thus reduces the aforementioned friction in the total overlapping region. The means 15 can also be arranged offset to the side from the center of the overlapped flow 2.

The invention has been described in detail with respect to exemplary embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A device for centering an overlapped flow of printed products, said device comprising:

a driven conveyor, provided with at least one transport element for moving the overlapped flow of products in a horizontal direction wherein the at least one transport element is disposed underneath the flow of the printed products to be moved in the horizontal direction;

a support located in one section of the driven conveyor, said support having arranged thereon driven alignment units for aligning both sides of the overlapped flow of products, said alignment units including a first alignment unit, arranged on the left side of the driven conveyor as seen in a transporting direction, and a second alignment unit arranged on the right side of the driven conveyor as seen in the transporting direction, wherein the first and second alignment units define an upstream-arranged intake region and a downstream-arranged steady-flow region, wherein the first and second alignment units in the intake region are conically converging and the first and second alignment units in the steady-flow region are non-conically converging; and a device arranged on the at least one transport element for loosening up the overlapped flow of products from below in both the intake and steady-flow regions.

2. The device according to claim 1, wherein the device for loosening the overlapped flow of products includes raised regions which strike the individual products in the overlapped flow vertically from below.

3. The device according to claim 1, wherein the intake region is provided with driven, vertical rollers across which an endless belt is placed on each side of the driven conveyor.

4. The device according to claim 3, wherein the endless belts are respectively arranged in a lower region of the vertical rollers.

5. The device according to claim 1, wherein vertical rollers are arranged in the steady-flow region which form a clear transport space and are exposed, so that the overlapped flow is guided directly on the vertical rollers in this steady-flow region.

6. A device for centering an overlapped flow of printed products, said device comprising:

a driven conveyor, provided with at least one transport element for moving the overlapped flow of products in a horizontal direction wherein the at least one transport element is disposed underneath the flow of the printed products to be moved in the horizontal direction;

a support located in one section of the driven conveyor, said support having arranged thereon driven alignment units for aligning both sides of the overlapped flow of products, said alignment units including a first alignment unit, arranged on the left side of the driven conveyor as seen in a transporting direction, and a second alignment unit arranged on the right side of the driven conveyor as seen in the transporting direction, wherein the first and second alignment units define an upstream-arranged intake region and a downstream-arranged steady-flow region, wherein the first and second alignment units in the intake region are conically converging and the first and second alignment units in the steady-flow region are non-conically converging; and a device disposed adjacent the at least one transport element for loosening up the overlapped flow of products from below in both the intake and steady-flow regions, wherein the device for loosening the overlapped flow of products includes raised regions which strike the individual products in the overlapped flow vertically from below.

7. The device according to claim 6, wherein the raised regions are respectively arranged on the at least one transport element, are designed as a transport roller and turn along with the at least one transport element.

8. The device according to claim 6, wherein the at least one transport element includes several transport rollers and at least some of the transport rollers are provided with more than one raised regions, the more than one raised regions are arranged along the circumference of each respective transport roller.

9. The device according to claim 6, wherein the raised regions are designed to project in a radial direction.

10. A device for centering an overlapped flow of printed products moving in a horizontal direction, the device comprising:

a driven conveyor including at least one transport element to convey the printed products in the horizontal direction, wherein the at least one transport element is disposed underneath the flow of the printed products;

a support coupled to the driven conveyor;

first and second alignment units coupled to the support and respectively positioned on each side of the driven conveyor to align both sides of the printed products moving in the horizontal direction, wherein the first and second alignment units define an upstream-arranged intake region and a downstream-arranged steady-flow region, wherein the first and second alignment units in the intake region are conically converging and the first and second alignment units in the steady-flow region are non-conically converging, and wherein the first and second alignment units include driven first vertical rollers coupled to an endless belt in the intake region, and exposed second vertical rollers in the steady-flow region such as to form a clear transport space where the printed products are guided directly on the exposed second vertical rollers; and a device arranged on the at least one transport element for loosening up the overlapped flow of printed products from below in both the intake and steady-flow regions.

11. The device according to claim 10, wherein the device for loosening the overlapped flow of products includes raised regions which strike the individual products in the overlapped flow vertically from below.

12. The device according to claim 10, wherein the at least one transport element comprises transport rollers and raised regions are respectively arranged on the transport rollers and turn along with the transport rollers.

13. The device according to claim 10, wherein the at least one transport element includes a plurality of transport rollers and at least some of the transport rollers include more than one raised region, the more than one raised regions being arranged along the circumference of each respective transport roller.

14. The device according to claim 10, wherein the raised regions project in a radial direction.

15. The device according to claim 10, wherein the endless belts are respectively arranged in a lower region of the vertical rollers.

16. The device according to claim 10, wherein first and second alignment units of the intake region conically converge in the direction of conveyance.

* * * * *